US009080754B2

(12) United States Patent
Lin

(10) Patent No.: US 9,080,754 B2
(45) Date of Patent: Jul. 14, 2015

(54) CONNECTION DEVICE OF LIGHT RECEPTACLE OF DECORATION LIGHT STRING

(71) Applicant: De-Hui Lin, Zhubei (TW)

(72) Inventor: De-Hui Lin, Zhubei (TW)

( * ) Notice: Subject to any disclaimer, the term of this patent is extended or adjusted under 35 U.S.C. 154(b) by 141 days.

(21) Appl. No.: 13/902,991

(22) Filed: May 28, 2013

(65) Prior Publication Data

US 2014/0355277 A1 Dec. 4, 2014

(51) Int. Cl.
*F21V 21/002* (2006.01)

(52) U.S. Cl.
CPC ..... *F21V 21/002* (2013.01)

(58) Field of Classification Search
USPC ..... 362/391, 311.02
See application file for complete search history.

(56) References Cited

U.S. PATENT DOCUMENTS

| | | | | |
|---|---|---|---|---|
| 7,331,688 | B2 * | 2/2008 | Peng | 362/228 |
| 8,827,728 | B1 * | 9/2014 | Lin | 439/168 |
| 2013/0147369 | A1 * | 6/2013 | Zhang | 315/185 R |

* cited by examiner

*Primary Examiner* — Sikha Roy
(74) *Attorney, Agent, or Firm* — Leong C. Lei

(57) ABSTRACT

A light of a light string includes a receptacle having upper and lower sections. The upper section includes a support plate on which an LED straddles. The lower section includes therein a separation board and two stop boards having a wedge-like shape arranged at each side of the separation board. The pins of the LED extend into the lower section and each positioned against an upright face of the separation board and the stop boards. Metal cores of electrical wires that are partially stripped are received between the stop boards to contact the pins of the LED. A bottom lid having holding board provided thereon is coupled to the lower section, so that the holding boards force the metal cores of the electrical wires into tight engagement with the pins of the LED by being fixed between the separation board and the stop boards.

8 Claims, 6 Drawing Sheets

CONNECTION DEVICE OF LIGHT RECEPTACLE OF DECORATION LIGHT STRING

(a) TECHNICAL FIELD OF THE INVENTION

The present invention generally relates to a design of connection structure for connecting a light-emitting element received in a receptacle of a light string to electrical wires.

(b) DESCRIPTION OF THE PRIOR ART

Light strings that are similar to that will be described herein are readily available in large number in the market. Such light strings often include light-emitting diodes to serve as the elements for emitting light. The connection between the light-emitting diodes and electrical wires is often realized through "piercing", where contactors having sharp ends are set up in the receptacle and are in contact engagement with the pins of a light-emitting diode and the electrical wires are laid flat on a top of a bottom lid. When the bottom lid and the receptacle are coupled to each other, the sharp ends of the contacts of the receptacle are caused to pierce through the insulation jackets of the electrical wires and thus electrically connect metal cores of the wires. However, this way of connection with electrical wires through piercing may easily cause undesired breaking and separation of the electrical wires, leading potential risk of shorting of the entire light string. Apparently, such an arrangement is not perfect and further improvement may be desired.

SUMMARY OF THE INVENTION

To overcome the above discussed drawbacks of the conventional way of connection between a light-emitting element received in a receptacle of a light string and electrical wires, the present invention proposes to put away such a known way of connection by piercing sharp ends of contacts through electrical wire and instead, direct contact established between pins of a light-emitting diode and exposed portions of metal cores of partially-stripped electrical wires is adopted for the purposes of avoiding the occurrence of wire breaking.

To achieve the above object, the present invention provides a light of a light string that comprises a receptacle body comprising upper and lower sections. The upper section comprises a support plate mounted therein at a center to receive a light-emitting diode (LED) to straddle thereon. A cover is fit to the upper section. The lower section comprises a separation board mounted therein at a center and two stop boards that are spaced from each other at a fixed interval and are of a wedge configuration that is expanded at top and reduced at bottom to define a slant surface facing inwardly. The light-emitting diode has four pins extending into she lower section and positioned on the separation board. The electrical wires are partially stripped off to expose metal cores that are respectively received between the separation board and the stop boards of the lower section to be in contact engagement with the pins of the light-emitting diode. A bottom lid that comprises left and right holding boards mounted thereto is coupled to the lower section, whereby the left and right holding boards push the four electrical wires upwards, so that the slant surfaces of the stop boards provides a camming effect to have the metal cores of the electrical wires and the pins of the light-emitting diode tightly fixed between the separation board and the stop boards. As such, electrical connection between the electrical wires and the light-emitting diode can be accomplished without terminal piercing, so that the problem of damage and breaking of the electrical wires caused by piercing can be completely avoided.

The present invention provides a lower section that comprises two wire retention plates projecting from opposite sides of a circumferential wall and further extending downward, wherein the wire retention plates each form, in an inner surface thereof, four semi-circular juxtaposing wire grooves, and a bottom lid having a circumferential wall forming openings, at opposite sides thereof, to correspond to the wire retention plates of the lower section, wherein four semi-circular notches are formed in a bottom wall of the bottom lid within each of the openings to correspond to the wire grooves of the corresponding wire retention plate, whereby the wire notches of the bottom lid and the wire grooves of the wire retention plates collaboratively and tightly clamp bent portions of the electrical wires therebetween to protect metal cores of the wires from breaking resulting from undue stretching caused by external forces.

In the disclosure, an embodiment is described with reference to a light-emitting diode having four pins and four electrical wires. However, it is contemplated that the present invention can be embodied in a light string that includes a light adopting a light-emitting diode having two, three or more than four pins and two, three, or more than four electrical wires, which are considered within the scope of the present invention.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
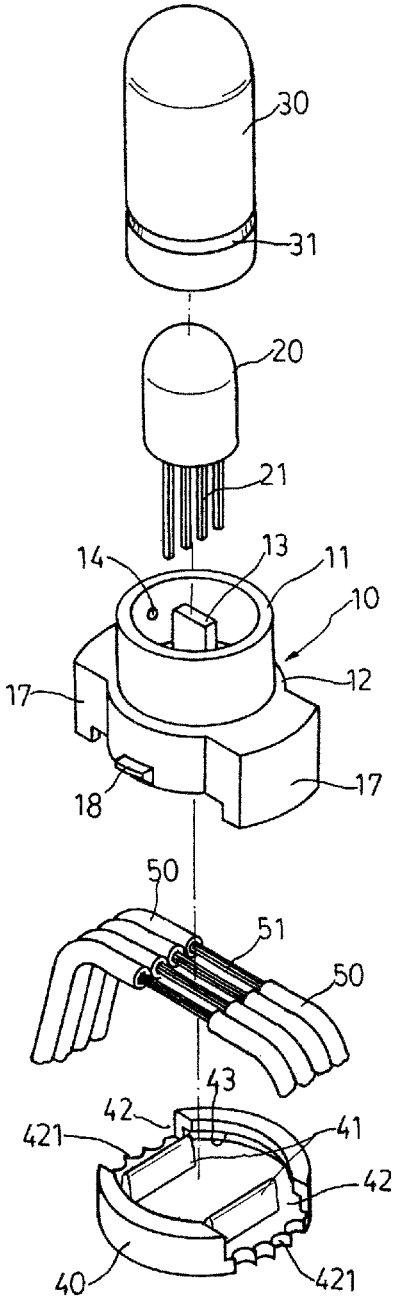
FIG. 1 is an exploded view of a first embodiment of the present invention.
Figure 2:
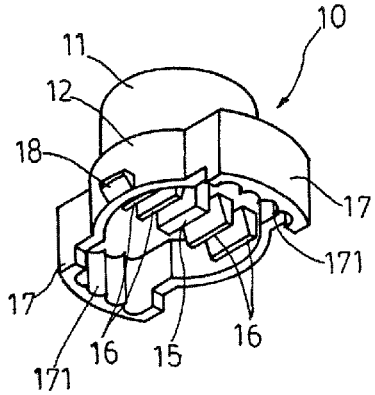
FIG. 2 is a perspective view, taken from the bottom side, of a receptacle body of the first embodiment of the present invention.
Figure 3:
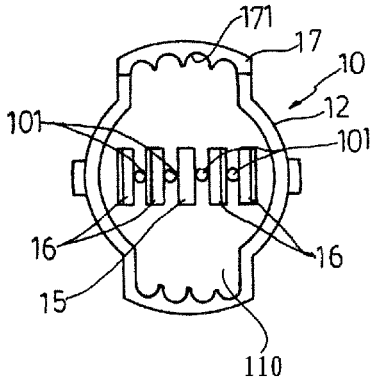
FIG. 3 is a bottom view of the receptacle body of the first embodiment of the present invention.
Figure 4:
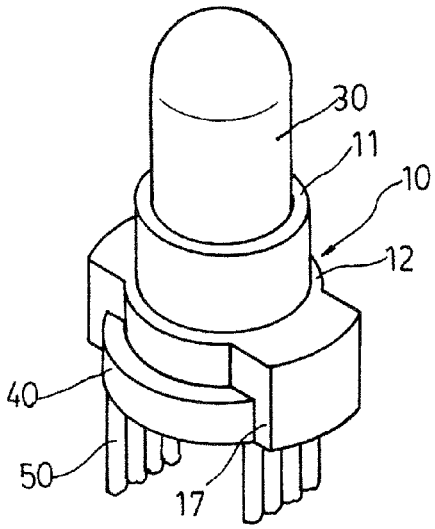
FIG. 4 is a perspective view showing the first embodiment of the present invention in an assembled form.
Figure 5:
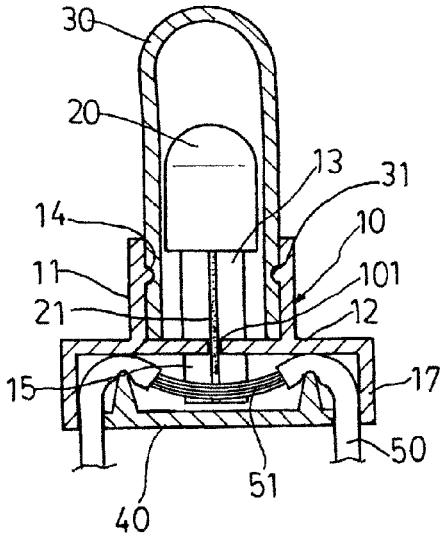
FIG. 5 is a cross-sectional view of the first embodiment of the present invention.
Figure 6:
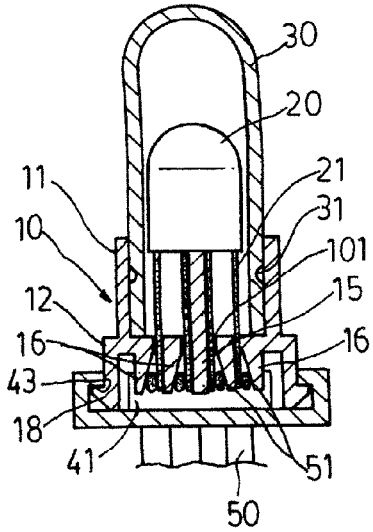
FIG. 6 is another cross-sectional view of the first embodiment of the present invention.
Figure 7:
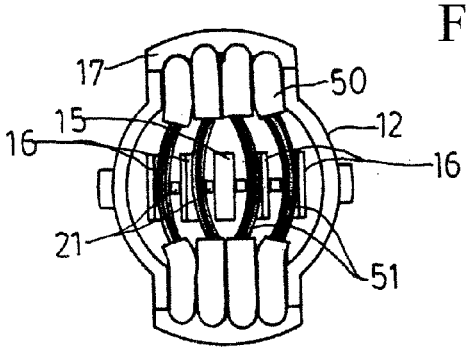
FIG. 7 is a top plan view showing electrical wires coupled to a bottom lid of the first embodiment of the present invention.

Referring to FIGS. 1-7, a first embodiment of connection device of light receptacle of light string according to the present invention is illustrated, comprising a receptacle body (10), a light-emitting diode (20), a cover (30), a bottom lid (40), and electrical wires (50). The receptacle body (10) comprises an upper section (11) and a lower section (12) that are hollow and are spaced from each other by a partition board 110. The upper section (11) comprises a support plate (13) mounted therein at the center thereof. The upper section (11) has an inner circumferential wall on which coupling projections (14) are formed. The lower section (12) comprises a separation board (15) mounted therein at the center thereof and two stop boards (16) mounted at each side of the separation board (15) and spaced at a fixed interval and having a wedge configuration that is top expanded and bottom reduced by comprising a slant surface that faces inwardly. The partition board 110 comprises a through hole (101) formed therein between the separation board (15) and each of the stop boards (16) adjacent thereto and between adjacent ones of the stop boards (16) so that the through hole extends between the upper section (11) and the lower section (12). Two wire retention plates (17) are provided on opposite sides of a circumferential wall of the lower section (12) and each comprises a first portion extending radially from the circumferential wall of the lower section (12) and a second portion extending downward from the first portion. Four wire grooves (171), which are preferably semi-circular in cross-section, are formed in an inside surface of the second portion of each wire retention plate (17) to juxtapose each other. Coupling lugs (18) are provided on another two opposite sides of the circumferential wall of the lower section (12) and are generally located at a lower end of the circumferential wall. The light-emitting diode (20) comprises four pins (21), of which two central pins are arranged to straddle on the support plate (13) of the upper section (11). The cover (30) is fit to the upper section (11) to house the light-emitting diode (20) and has an outer surface in which a coupling recess (31) is formed for engagement and coupling with the coupling projections (14) formed on the inner circumferential wall of the upper section (11). The bottom lid (40) has a circumferential wall in which openings (42) are formed at locations respectively corresponding to the wire retention plates (17) of the lower section (12) and also comprises four wire notches (421), preferably semi-circular in shape, formed in a bottom wall thereof within each opening (42) at locations corresponding to the wire grooves (171) of the corresponding wire retention plate (17). The bottom lid further comprises left and right holding boards (41) formed on the bottom wall at locations close to and facing the two openings (42). The circumferential wall of the bottom lid (40) has a top forming inwardly projecting coupling flanges (43). The electrical wires (50), which in the embodiment are of a number of four, are each partially stripped off an insulation jacket thereof to expose a portion of a metal core (51). The four pins (21) of the light-emitting diode (20) are respectively received through the through holes (101). The electrical wires (50) are bent at locations at opposite sides of the stripped portion and the bent portions are received in the wire grooves (171) of the wire retention plates (17) of the lower section (12) so that the metal cores (51) of the four wires are respectively positioned between the separation board (15) and the stop boards (16) and between adjacent stop boards (16) to respectively engage the four pins (21) of the light-emitting diode (20). The bottom lid (40) is coupled to the lower section (12) by having the coupling lugs (18) of the lower section (12) and the coupling flange (43) of the bottom lid (40) engaging each other so that the left and right holding boards (41) of the bottom lid (40) push the electrical wires (50) upward and forcibly move the metal cores (51) to induce tight clamping engagement between the metal cores (51) of the four electrical wire and the four pins (21) of the light-emitting diode (20) by means of the slant surface and the wedge configuration of the stop boards (16). The wire notches (421) of the bottom lid (40) and the wire grooves (171) of the wire retention plates (17) collaboratively and tightly clamp the bent portions of the electrical wires (50) therebetween to protect the metal cores of the electrical wires from breaking caused by undue stretching of the wires by external forces.

Figure 8:
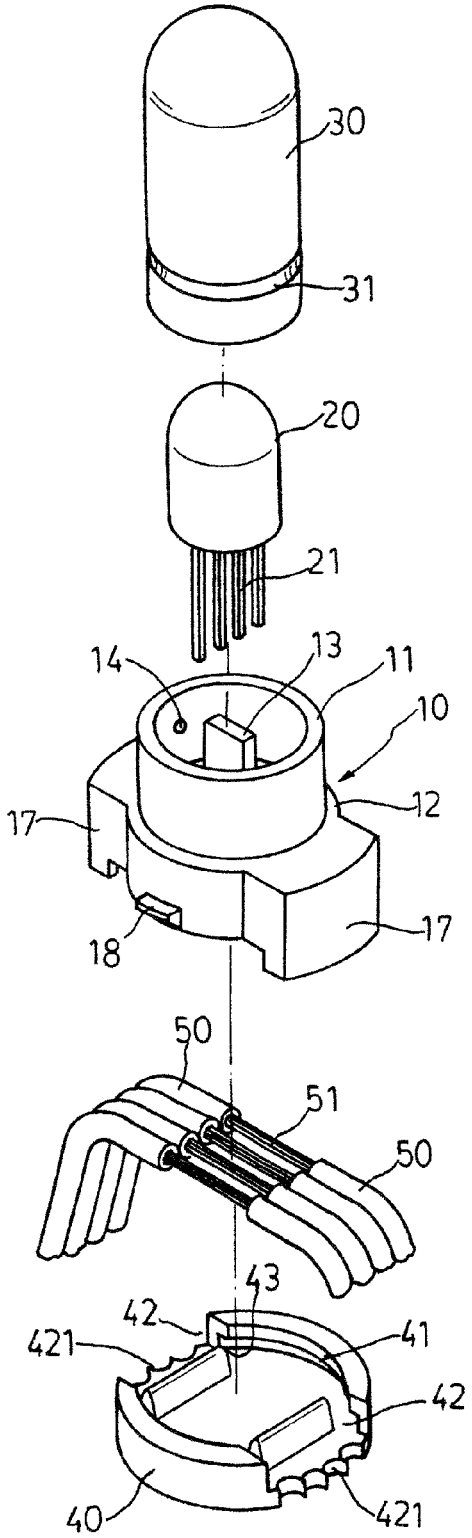
FIG. 8 is an exploded view of a second embodiment of the present invention.
Figure 9:
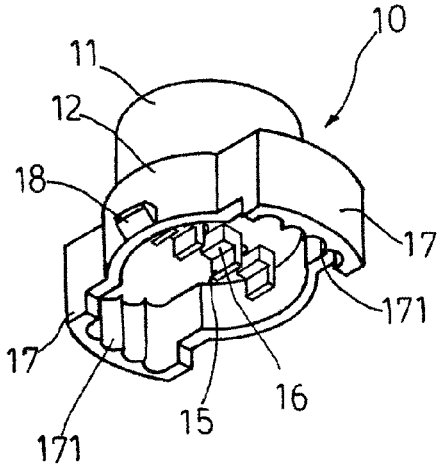
FIG. 9 is a perspective view, taken from the bottom side, of a receptacle body of the second embodiment of the present invention.
Figure 10:
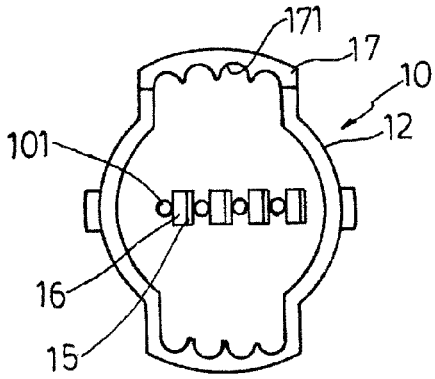
FIG. 10 is a bottom view of the receptacle body of the second embodiment of the present invention.
Figure 11:
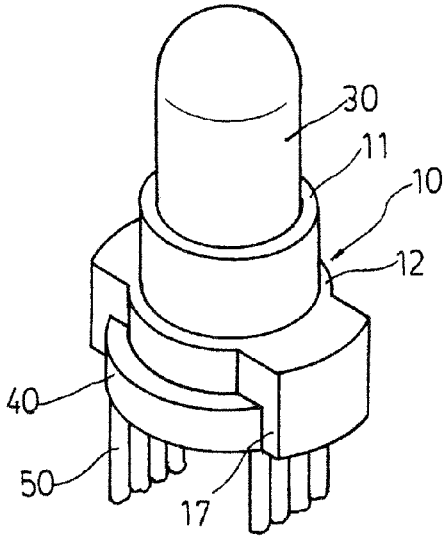
FIG. 11 is a perspective view showing the second embodiment of the present invention in an assembled form.
Figure 12:
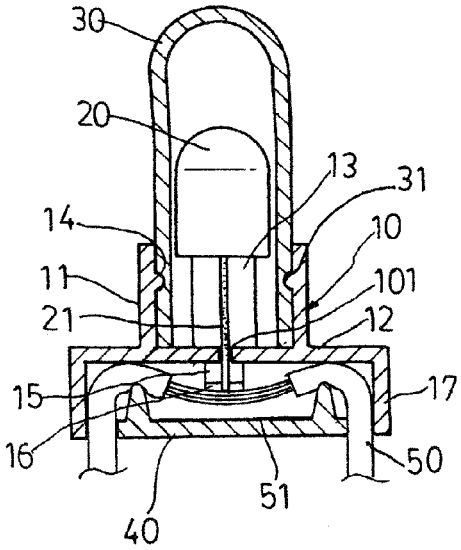
FIG. 12 is a cross-sectional view of the second embodiment of the present invention.
Figure 13:
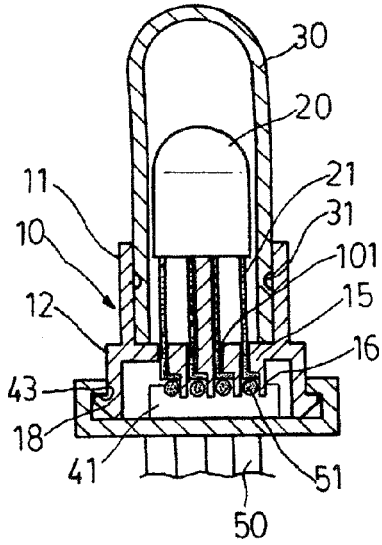
FIG. 13 is another cross-sectional view of the second embodiment of the present invention.
Figure 14:
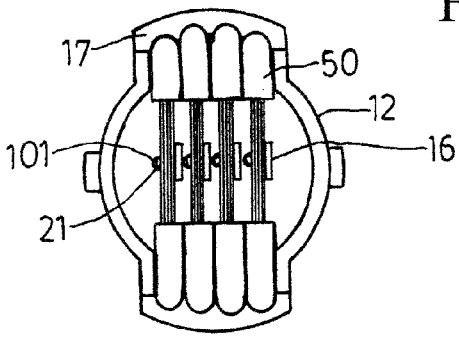
FIG. 14 is a top plan view showing electrical wires coupled to a bottom lid of the second embodiment of the present invention.

Referring to FIGS. 8-14, a second embodiment of connection device of light receptacle of light string according to the present invention is illustrated, which has a structure that is substantially identical to that of the first embodiment. The difference resides in that the separation board (15) and the stop boards (16) of the lower section (12) are arranged in a different way, in which four separation boards (15) are arranged in the lower section (12) to alternate the through holes (101) and thus at least some of the separation boards (15) are each between adjacent ones of the four through holes (101) of the partition board 110 and each of the separation boards has a distal end face on which a stop board (16) is formed at one edge thereof so as to form a step-like configuration. The four pins (21) of the light-emitting diode (20), after set through the through holes (101), are bent at distal ends thereof in a substantially perpendicular manner to be positioned on the end faces of the separation boards (15). The electrical wires (50) are bent and the bent portions are received in the wire grooves (171) of the wire retention plates (17) of the lower section (12) so that the metal cores (51) are respectively positioned on the separation boards (15) to engage the bent ends of the pins (21) of the light-emitting diode (20) that are located on the end faces of the separation boards and the stop boards (16) isolate the metal cores (51) from each other. The bottom lid (40) is coupled to the lower section (12) by having the coupling lugs (18) of the lower section (12) and the coupling flange (43) of the bottom lid (40) engaging each other. The left and right holding boards (41) of the bottom lid (40) push the electrical wires (50) upward and forcibly move the metal cores (51) to have the metal cores (51) of the electrical wires in tight engagement with the bent ends of the pins (21) of the light-emitting diode (20).

Figure 15:
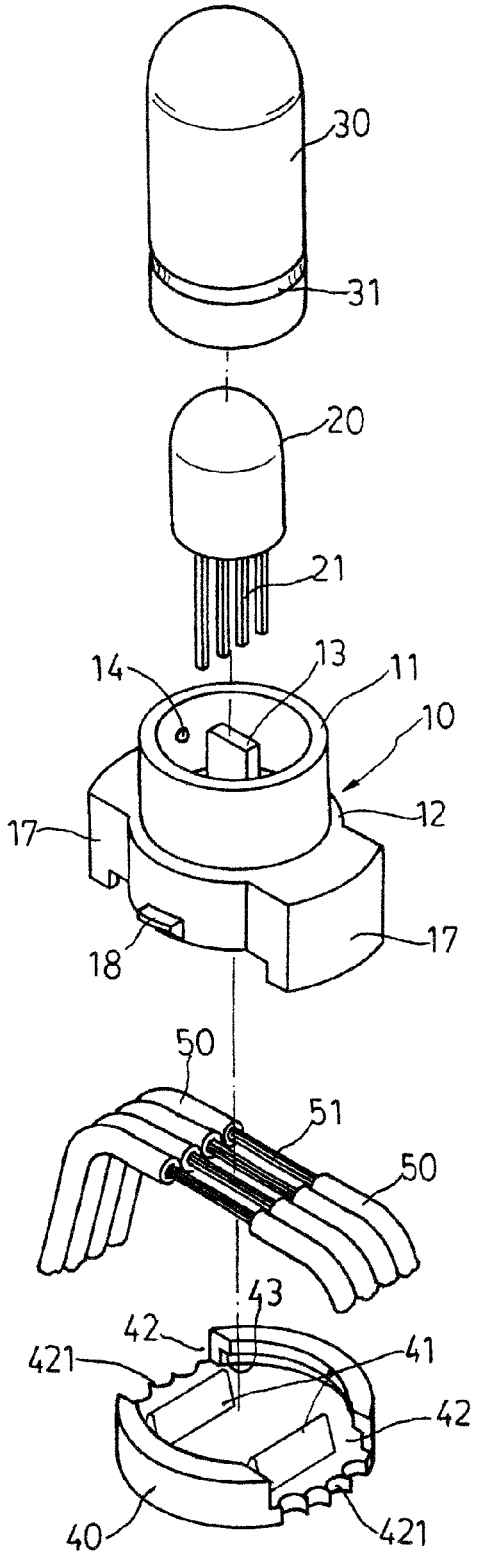
FIG. 15 is an exploded view of a third embodiment of the present invention.
Figure 16:
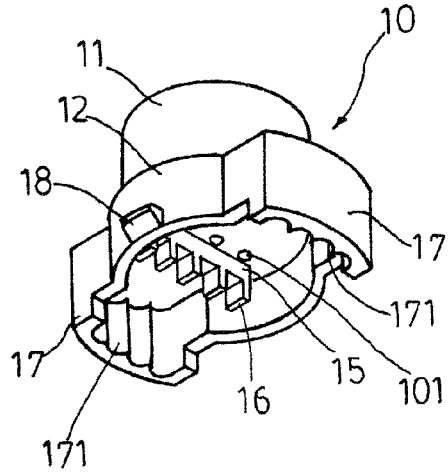
FIG. 16 is a perspective view, taken from the bottom side, of a receptacle body of the third embodiment of the present invention.
Figure 17:
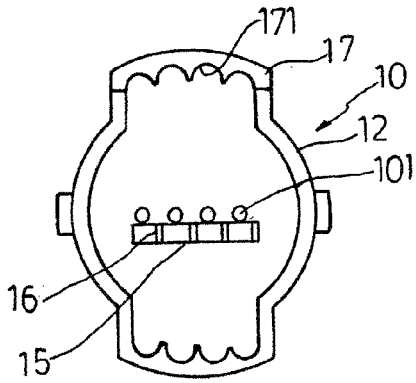
FIG. 17 is a bottom view of the receptacle body of the third embodiment of the present invention.
Figure 18:
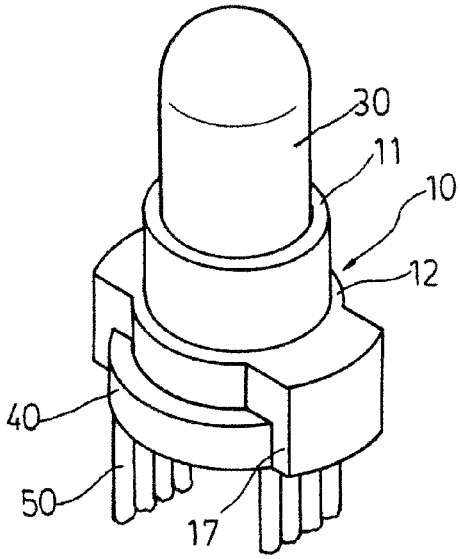
FIG. 18 is a perspective view showing the third embodiment of the present invention in an assembled form.
Figure 19:
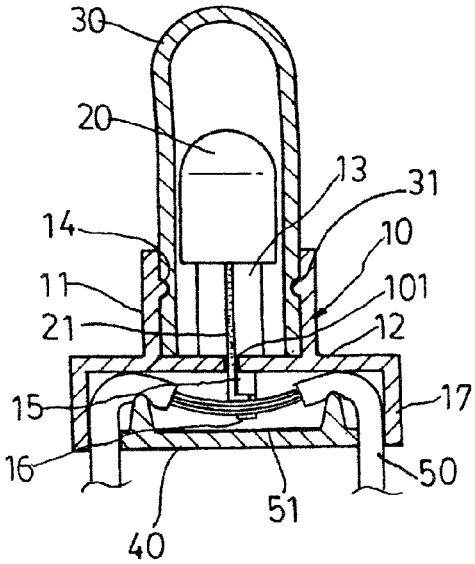
FIG. 19 is a cross-sectional view of the third embodiment of the present invention.
Figure 20:
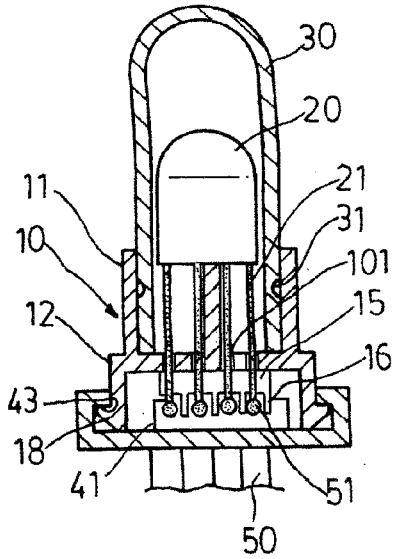
FIG. 20 is another cross-sectional view of the third embodiment of the present invention.
Figure 21:
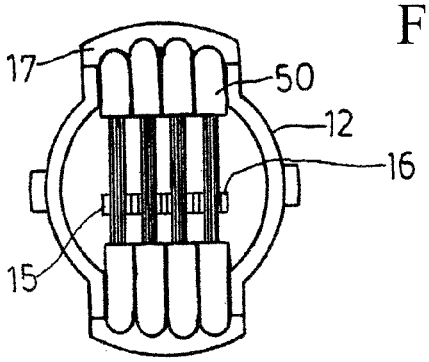
FIG. 21 is a top plan view showing electrical wires coupled to a bottom lid of the third embodiment of the present invention.

Referring to FIGS. 15-21, a third embodiment of connection device of light receptacle of light string according to the present invention is illustrated, which has a structure that is substantially identical to that of the first embodiment. The difference resides in that the separation board (15) and the stop boards (16) of the lower section (12) are arranged in a different way, in which single separation board (15) is provided in the lower section (12) at one side of the four through holes (101) to be substantially parallel with a straight line extending through the four through holes (101). The separation board (15) has an end face that is provided with four stop boards (16) respectively at locations alternating the four through holes (101) so that at least some of stop boards (16) are each at a location corresponding the spacing between every two adjacent ones of the four through holes (101). The four pins (21) of the light-emitting diode (20) are respectively received through the through holes (101) and each has a distal end that is bent to be substantially parallel to the electrical wires (50) and positioned on the end face of the separation board (15). The electrical wires (50) are bent and positioned in the wire grooves (171) of the wire retention plates (17) of the lower section (12) to have the four metal cores (51) set on the end face of the separation board (15). The four metal cores (51) are arranged to be isolated from each other by the stop boards (16) and the four metal cores (51) are in contact engagement with the bent ends of the pins (21) of the light-emitting diode (20). The bottom lid (40) is coupled to the lower section (12) by having the coupling lugs (18) of the lower section (12) and the coupling flange (43) of the bottom lid (40) engaging each other. The left and right holding boards (41) of the bottom lid (40) push the electrical wires (50) upward and forcibly move the metal cores (51) to have the metal cores (51) of the electrical wires in tight engagement with the bent ends of the pins (21) of the light-emitting diode (20).

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connection device of light receptacle of light string, comprising a receptacle body, a light-emitting diode, a cover, a bottom lid, and electrical wires, the receptacle body comprising an upper section and a lower section, the upper section comprising a support plate mounted therein at center thereof, the lower section comprising a separation board mounted therein at center thereof and two stop boards at each side of the separation board, the light-emitting diode being arranged to straddle on the support plate and having four pins extending into the lower section to be positioned against the separation board and the stop boards, the cover being fit to the upper section to house the light-emitting diode, the electrical wires being of a number of four, the electrical wires being stripped off insulation jackets to expose metal cores, the electrical wires being bent and positioned on the lower section to set the metal cores respectively between the separation board and the stop boards and between the stop boards and in contact engagement with the pins of the light-emitting diode, wherein the stop boards of the lower section are arranged to be spaced at a fixed interval and have a wedge configuration having expanded top end and reduced bottom end to define a slant surface facing inwardly, the bottom lid comprising left and right holding boards, the bottom lid being coupled to the lower section in such a way that the left and right holding boards push the electrical wires upward, whereby the slant surfaces of the stop boards allow the metal cores of the electrical wires and the pins of the light-emitting diode to be tightly clamped between the separation board and the stop boards.

2. The connection device of light receptacle of light string according to claim 1, wherein the lower section of the receptacle body has a circumferential wall from opposite sides of which wire retention plates project and further extend downward, each of the wire retention plates having an inside surface in which four semi-circular and juxtaposing wire grooves are formed, the bottom lid having a circumferential wall in which openings are formed at locations respectively corresponding to the wire retention plates of the lower section and a bottom wall in which four semi-circular wire notches are formed within each of the openings at locations corresponding to the wire grooves of the corresponding wire retention plate, whereby the wire notches of the bottom lid and the wire grooves of the wire retention plates securely and tightly clamp the bent portions of the electrical wires therebetween.

3. The connection device of light receptacle of light string according to claim 1, wherein the upper section and the lower section of the receptacle body is separated by a partition board in which four through holes are defined to be respectively located between the separation board and the stop boards and between adjacent ones of the stop boards, the through holes extending between the upper section and the lower section to receive extension of the pins of the light-emitting diode therethrough.

4. The connection device of light receptacle of light string according to claim 1, wherein the lower section comprises a circumferential wall on which two coupling lugs are formed at opposite sides thereof, the bottom lid having a circumferential wall having a top forming inwardly-projecting coupling flange, whereby the bottom lid is coupled to the lower section by having the coupling lugs and the coupling flange with each other.

5. The connection device of light receptacle of light string according to claim 1, wherein the upper section of the receptacle body has an inner circumferential wall on which a coupling projection is formed, the cover having an outer surface in which a coupling recess is formed and engageable with the coupling projection formed on the inner circumferential wall of the upper section.

6. The connection device of light receptacle of light string according to claim 1, wherein the lower section comprises left and right holding boards, the bottom lid comprising the separation board mounted therein at center thereof and two stop boards at each side of the separation board to be fit into the lower section, the stop boards being arranged to be spaced at a fixed interval and having a wedge configuration having expanded top end and reduced bottom end to define a slant surface facing inwardly, whereby the left and right holding boards push the electrical wires downward so that the slant surfaces of the stop boards allow the metal cores of the electrical wires and the pins of the light-emitting diode to be tightly clamped between the separation board and the stop boards.

7. A connection device of light receptacle of light string, comprising a receptacle body, a light-emitting diode, a cover, a bottom lid, and electrical wires, the receptacle body comprising an upper section and a lower section, the upper section comprising a support plate mounted therein at center thereof, a partition board separating the upper and lower sections and comprising two through holes formed at each side of the support plate and spaced from each other at a fixed interval, the through holes extending between the upper and lower sections, the light-emitting diode being arranged to straddle on the support plate and having four pins extending through the through holes into the lower section, the cover being fit to the upper section to house the light-emitting diode, the electrical wires being bent and positioned in the lower section and being of a number of four, the electrical wires being stripped off insulation jackets to expose metal cores, wherein the lower section comprises a separation board arranged between adjacent ones of the through holes of the lower section, each separation board having an end face having an edge on which stop board is formed, ends of the pins of the light-emitting diode being bent to be substantially perpendicular to the electrical wires and positioned on the end faces of the separation boards, the metal cores of the electrical wires being positioned on the end faces of the separation boards, the metal cores being isolated from each other by the stop boards, the metal cores being in contact engagement with the bent ends of the pins of the light-emitting diode, the bottom lid comprising left and right holding boards, the bottom lid being coupled to the lower section in such a way that the left and right holding boards push the electrical wires upward and move the metal core to have the metal cores of the electrical wires and the pins of the light-emitting diode in tight engagement with each other.

8. A connection device of light receptacle of light string, comprising a receptacle body, a light-emitting diode, a cover, a bottom lid, and electrical wires, the receptacle body comprising an upper section and a lower section, the upper section comprising a support plate mounted therein at center thereof, a partition board separating the upper and lower sections and comprising two through holes formed at each side of the support plate and spaced from each other at a fixed interval, the through holes extending between the upper and lower sections, the light-emitting diode being arranged to straddle on the support plate and having four pins extending through the through holes into the lower section, the cover being fit to the upper section to house the light-emitting diode, the electrical wires being bent and positioned in the lower section and being of a number of four, the electrical wires being stripped off insulation jackets to expose metal cores, wherein the lower section comprises a separation board formed at one side of the through holes and parallel to the through holes, the separation board having an end face on which a stop board is formed at a location corresponding to spacing between adjacent ones of the through holes, ends of the pins of the light-emitting diode being bent to be substantially parallel to the electrical wires and positioned on the end face of the separation board, the metal cores being isolated from each other by the stop boards, the metal cores being in contact engagement with the bent ends of the pins of the light-emitting diode, the bottom lid comprising left and right holding boards, the bottom lid being coupled to the lower section in such a way that the left and right holding boards push the electrical wires upward and move the metal core to have the metal cores of the electrical wires and the pins of the light-emitting diode in tight engagement with each other.

* * * * *